United States Patent [19]

Miyamoto et al.

[11] Patent Number: 4,770,816

[45] Date of Patent: Sep. 13, 1988

[54] INSULATING OIL AND ELECTRICAL APPARATUS FILLED WITH THE SAME

[75] Inventors: Teruo Miyamoto; Motoo Tsuchie, both of Ako, Japan

[73] Assignee: Mitsubishi Denki Kabushiki Kaisha, Japan

[21] Appl. No.: 116,545

[22] Filed: Nov. 4, 1987

[30] Foreign Application Priority Data

Nov. 5, 1986 [JP] Japan ..... 61-263141

[51] Int. Cl.[4] ..... H01B 3/20

[52] U.S. Cl. ..... 252/576; 174/17 LF; 174/23 C; 174/25 C; 252/51.5 R; 252/403; 336/94; 361/315; 361/319; 361/327; 564/462; 585/6.3; 585/6.6

[58] Field of Search ..... 252/51.5 R, 403, 576; 585/6.3, 6.6; 174/17 LF, 23 C, 25 C; 336/94; 361/315, 319, 327; 564/462

[56] References Cited

U.S. PATENT DOCUMENTS 3,225,099 12/1965 Coffield ..... 252/576

FOREIGN PATENT DOCUMENTS 744299 10/1966 Canada ..... 252/576
50-15320 6/1975 Japan .
54-137698 10/1979 Japan .

*Primary Examiner*—Robert Wax
*Attorney, Agent, or Firm*—Leydig, Voit & Mayer

[57] ABSTRACT

An insulating oil containing N,N-bis(2-hydroxyethyl)-N-cyclohexylamine at 0.5 mg/l or more. An electrical apparatus is filled with the insulating oil in which a copper component is immersed. During operation of the apparatus for a long period of time, the tan δ of the insulating oil does not increase so that deterioration of the insulating oil is deferred, thereby substantially extending the life of the insulating oil.

7 Claims, 3 Drawing Sheets

INSULATING OIL AND ELECTRICAL APPARATUS FILLED WITH THE SAME

BACKGROUND OF THE INVENTION

This invention relates to an insulating oil and an electrical apparatus filled with the same in which deterioration of the insulating oil can be effectively suppressed.

In an electrical apparatus, the insulating oil will gradually deteriorate due to its oxidation over a long period of time. As a result, the characteristics of the insulating oil such as resistivity, dielectric tangent (tan δ), acid value, surface tension and the like become low. As the insulating oil deteriorates, sludge is formed in the insulating oil, making it difficult for the oil to perform its intended insulating function. Accordingly, to avoid the oxidative deterioration of the insulating oil, many electrical apparatus each having an insulating oil filled therein, have been developed. One of the electrical apparatus thus developed is of a nitrogen gas charged in a vessel type in which nitrogen gas is sealingly charged in a space above the surface of the insulating oil so as to prevent air from contacting the insulating oil. Another apparatus is of a barrier membrane conservator type. These types of apparatus are popular these days and no great deterioration of the insulating oil such as generation of sludge occurs.

In case of a transformer, however, the tan δ of the insulating oil filled therein will increase within about one year in some cases, or usually in five to seven years in many cases, depending on the operating load, the structure of the electrical apparatus or the like. Namely, a very large tan δ of the used insulating oil, which is not anticipated from that of a new oil, can be observed within a few years of use. On the other hand, during the use, there is no substantial decrease in the surface tension or no substantial increase in the acid value of the insulating oil, which are indicators of the deterioration.

These phenomena can also be simulated in a laboratory. FIG. 1 is a diagrammatic view showing a heating time dependence of the tan δ of an insulating oil without any additives. The test as shown in FIG. 1 is performed by immersing a copper component such as a copper plate having a surface area to oil volume ratio of 44.8 $cm^2$/100 ml into an insulating oil, blowing oxygen into the insulating oil at a ratio of 10 ml-oxygen to 100 ml-oil, heating the insulating oil and the copper plate in the insulating oil at 95° C., and continuously measuring the tan δ of the insulating oil using electrodes which are also immersed in the insulating oil. The copper plate represents a dummy of a paper-covered copper wire, namely, if the copper component is not present, the tan δ of the insulating oil does not increase. Under the above experimental condition, it is known that one hour heating of the insulating oil with the copper component immersed therein corresponds to about one year operation of the electrical apparatus.

As a method for measuring an extreme deterioration of the insulating oil in which sludge is generated, there is the JIS (Japanese Industrial Standard) C 2101 test method. This test method is performed by subjecting the surface of the insulating oil to an oxygen atmosphere, oxidatively deteriorating the insulating oil in the presence of copper at 120° C for 75 hours, and evaluating the oxidation stability of the insulating oil from the amount of sludge generted and the total acid value after the deterioration of the insulating oil.

The same test or evaluation method is also adopted in other industrial standards such as IEC Pub. 74, ASTM D-1904 and the like. In such a test, it has been proved that the deterioration of the insulating oil can effectively be suppressed by the addition of about 0.1% to 1.0% of an anti-oxidizing agent in the form of dibutyl tertiary paracresol (hereinafter abbreviated as DBPC). For this reason, the oxidation stability test for a DBPC added insulating oil is normalized in the above IEC and ASTM standards, and an insulating oil added by DBPC is already put to practical use.

As an insulating oil for an electrical apparatus, it is not desirable to use an additive from the point of maintenance of the apparatus such as exchange or replenishment of the insulating oil during the operation. However, there was no choice but to use DBPC in the insulating oil before development of the above-mentioned electrical apparatuses which can prevent the oxidative deterioration of an insulating oil. Therefore, DBPC is still used at present. If an additive is added to an insulating oil, however, the following merits can also be obtained. For example, Japanese Patent Publication No. 50-15320 shows an electrical insulating oil in which 0.1% to 3% of a non-ionic surface active agent is mixed into a mineral oil for preventing degradation of dielectric strength due to the influence of moisture or other impurities. Also, Japanese Patent Laid-Open No. 54-137698 shows an electrical insulating oil compound in which polyoxyethylene alkylamine is added to an insulating oil for suppressing a streaming electrification. Further, Japanese Patent Laid-Open No. 52-109199 shows an electrical apparatus using an insulating oil containing a polyether for suppressing a streaming electrification.

The above Japanese Patent Laid-Open No. 54-137698, discloses that a decrease in volume resistivity and an increase in the dielectric tangent during a continued thermal deterioration test are small for an insulating oil containing polyoxyethylene alkylamine. However, this reference differs from the present invention in their objects, kinds of additives used, and the manner of use thereof.

On the other hand, it is known that the above-mentioned DBPC can suppress the oxidative deterioration. Thus, experimental results of an insulating oil containing by 0.3% DBPC, tested in the same manner as shown in FIG. 1, are illustrated in FIG. 2. From this latter figure, it is found that the tan 6 of the insulating oil containing DBPC is rather larger than that of the insulating oil without any additive at the initial stage of the deterioration.

In an existing electrical apparatus in which oxygen is prevented from contacting the surface of an insulating oil contained therein, no sludge will be generated by using the insulating oil containing DBPC. However, there arises another problem in that the DBPC added to the insulating oil will increase the tan δ of the insulating oil.

SUMMARY OF THE INVENTION

Accordingly, an object of the present invention is to provide an insulating oil and an electrical apparatus filled with the same in which an increase in the dielectric tangent of the insulating oil is suppressed during the operation of the apparatus to defer the deterioration of the insulating oil, thereby enabling the insulating oil to be used for an extended period of time.

In order to achieve the above object, according to one aspect of the present invention, there is provided an insulating oil containing N,N-bis(2-hydroxyethyl)-N-cyclohexylamine.

According to another aspect of the present invention, there is provided an electrical apparatus using an insulating oil which comprises: a vessel; an insulating oil accommodated in the vessel and containing N,N-bis(2-hydroxyethyl)-N-cyclohexylamine therein; and a copper component immersed into the insulating oil.

BRIEF DESCRIPTION OF THE DRAWINGS

The present invention will be more readily apparent from the following detailed description of a preferred embodiment and examples of the present invention when taken in conjunction with the accompanying drawings, in which.

DESCRIPTION OF THE PREFERRED EMBODIMENT

Figure 1:
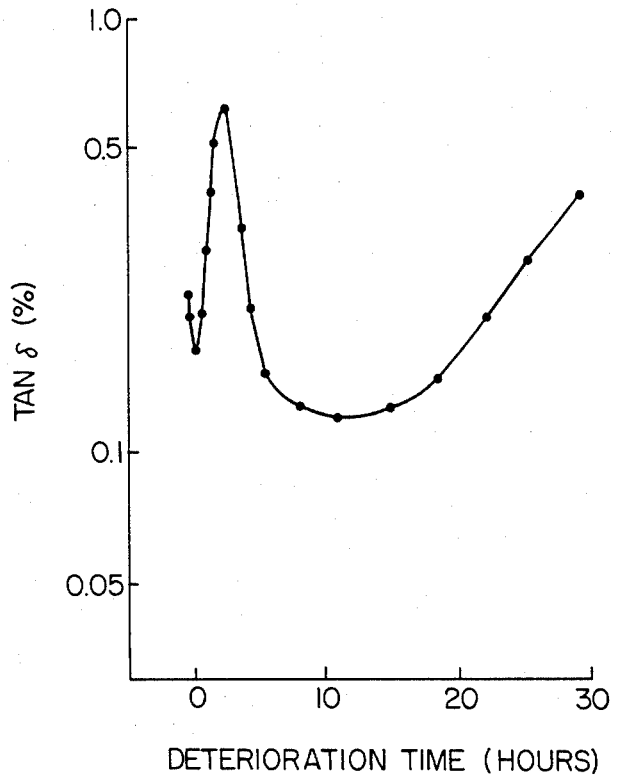
FIG. 1 PRIOR ART
FIGS. 1 and 2 are diagrammatic views showing a change in the dielectric tangent (tan δ) of conventional insulating oil as a function of deterioration time.

An embodiment of the present invention will be described hereinafter.

It was experimentally found that a change in the dielectric tangent (tan δ) of an insulating oil takes place, namely tangent increases, when the following two conditions are satisfied.

(1) Existence of oxygen even in a very small quantity and (2) Existence of copper dissolved in the insulating oil.

A small quantity of oxygen remains in the insulating oil when manufacturing an oil-filled electrical apparatus. Copper conductors covered with insulating papers are immersed into the insulating oil to a large extent, and the copper in the conductors easily dissolves into the insulating oil through the insulating paper. Moreover, the relatively high temperature of the insulating oil in the electrical apparatus accelerates deterioration of the insulating oil.

The present inventors directed their attention to the second of the above-mentioned two factors, namely, the existence of copper in the insulating oil, and found that it is possible to restrain the increase in the tan δ if an interaction between the dissolved copper and oxygen or oxide in the insulating oil is hindered. As a result of this, it was found that the insulating oil, containing N,N-bis(2-hydroxyethyl)-N-cyclohexylamine according to the present invention, can solve the above-mentioned problem, namely, an increase in the tan δ of the insulating oil. The N,N-bis(2-hydroxyethyl)-N-cyclohexylamine reacts with copper quantitatively, therefore, even if there exists oxygen in the insulating oil, the above two conditions are not satisfied, making it possible to restrain an increase in the tan δ of the insulating oil.

For the insulating oil of the present invention, having the property of insulating the coils of electrical apparatus, JIS C 2320, IEC 296 Class I and II, ASTM D 3487 TYPE I and JbN , refined mineral oils, chlorinated aromatics, silicone oils, ester liquids and the like can be used.

In the present invention, N,N-bis(2-hydroxyethyl)-N-cyclohexylamine is added to the insulating oil at 0.5 mg/l or more, preferably in the range of 0.5 to 100 mg/l. If the amount of the additive added is less than 0.5 mg/l, effects of suppressing the deterioration of the insulating oil are insufficient. On the other hand, if the amount of addition is more than 100 mg/l, the suppressing effects are saturated and do not increase appreciably so that the suppressing effects proportional to the added amount can not be obtained. In this connection, it is to be noted that N,N-bis(2-hydroxyethyl)-N-cyclohexylamine is in a liquid state and can easily be dissolved in the insulating oil.

The insulating oil of the present invention may be used in an electrical apparatus as an insulator or a cooling medium and filled in a tank or vessel in which a paper-covered copper coils is provided.

The electrical apparatus according to the present invention includes a transformer, a switch gear, a condenser, a cable, a reactor or the like. A preferred electrical apparatus is of a nitrogen gas charged type in which nitrogen gas is charged in a space above the surface of the insulating oil instead of air, or of a conservator type having a barrier membrane for separating the insulating oil from air. The copper component is, for example, a copper wire, a copper foil or the like.

Next, examples of the present invention will be described hereinafter.

EXAMPLES 1 TO 4

Figure 2:
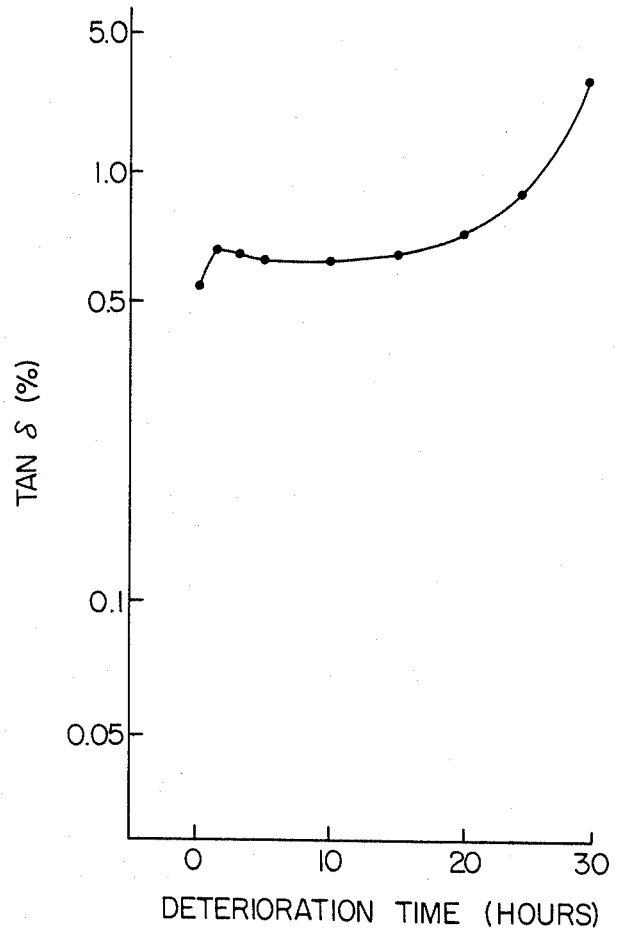
FIG. 2 PRIOR ART
Figure 3:
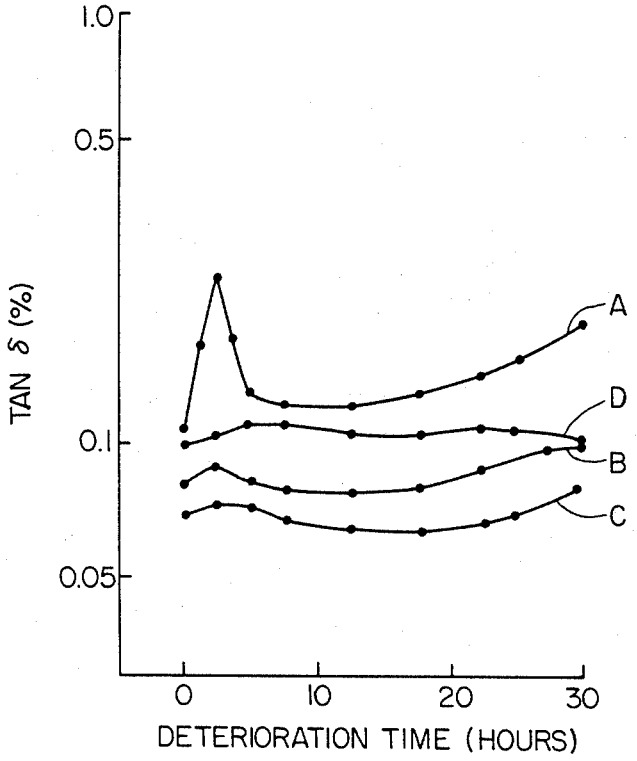
FIG. 3 is a diagrammatic view showing a change in the dielectric tangent (tan δ) of an insulating oil as a function of deterioration time in accordance with the examples of the present invention.

The change in the tan δ of insulating oils with respect to time were measured in the same manner as in FIG. 1 or 2. The insulating oils used was a high-voltage insulating oil sold under the trade name TN by NIHON SEKIYU CO., LTD. The results obtained are illustrated in FIG. 3, where the insulating oil contained N,N-bis(2-hydroxyethyl)-N-cyclohexylamine at 0.5 mg/l (Example 1, curve A in FIG. 3), 1 mg/l (Example 2, curve B in FIG. 3), 5 mg/l (Example 3, curve C in FIG. 3), and 100 mg/l (Example 4, curve D in FIG. 3), respectively. Test conditions were as follows: the surface area of a copper component was 44.8 $cm^2$/100 ml-oil, the quantity of oxygen present was 10 ml/100 ml-oil, and the temperature of the insulating oil 95° C.

As is clear from FIG. 3, the tan δ of the insulating oil including N,N-bis(2-hydroxyethyl)-N-cyclohexylamine in the range of 0.5 to 100 mg/l did not increase with time. Examples 5 to 9 and Comparative Example Several properties such as resistivity, tan δ (at 80° C.), breakdown voltage, acid value, and surface tension (at room temperature or at about 25° C.) of the insulating oil were measured under the same test conditions as in Examples 1 to 4. Samples of the insulating oil were composed of the high-voltage insulating oil TN and 0.5 mg/l (Example 5), 1 mg/l (Example 6), 15 mg/l (Example 7), 50 mg/l (Example 8), 100 mg/l (Example 9), and 0 mg/l (Compalative Example) of N,N-bis(2-hydroxyethyl)N-cyclohexylamine, respectively. The results obtained are listed in the following table.

TABLE

| Example No. | Added Amine* (mg/l) | at 80° C. resistivity (Ω· cm) | at 80° C. tan δ (%) | at room temp. (about 25° C.) breakdown voltage (KV/2.5 mm) | at room temp. (about 25° C.) acid value (mg KOH/g) | at room temp. (about 25° C.) surface tension (dyne/cm) |
|---|---|---|---|---|---|---|
| 5 | 0.5 | $7.6 \times 10^{15}$ | 0.007 | 78 | 0.003 | 48 |
| 6 | 1 | $7.6 \times 10^{15}$ | 0.007 | 78 | 0.003 | 48 |
| 7 | 15 | $7.4 \times 10^{15}$ | 0.008 | 79 | 0.003 | 48 |
| 8 | 50 | $7.4 \times 10^{15}$ | 0.008 | 79 | 0.003 | 48 |
| 9 | 100 | $7.2 \times 10^{15}$ | 0.009 | 79 | 0.003 | 47 |
| Com. Ex. | 0 | $7.6 \times 10^{15}$ | 0.007 | 78 | 0.003 | 48 |

Amine*: N,N—bis(2-hydroxyethyl)-N—cyclohexylamine

As shown in the above Table, it is observed that the dielectric breakdown voltage and the surface tention of the insulating oil are not lowered even in the case where the insulating oil contains a large amount of N,N-bis(2-hydroxyethyl)-N-cyclohexylamine such as at 100 mg/l. Accordingly, it will be understood that N,N-bis(2-hydroxyethyl)-N-cyclohexylamine can be utilized without having any harmful influence on the insulating oil and that it is very suitable as an additive to the insulating oil.

In the present invention, instead of an insulating oil, a lubricating oil can also be used and the same effects as mentioned above can be achieved.

While a preferred embodiment and examples of the present invention have been shown and described herein, it will the apparent to those skilled in the art that various changes and/or modifications thereof can be made without departing from the spirit and scope of the invention as defined in the appended claims.

What is claimed is:

1. A modified insulating oil comprising an insulating oil containing N,N-bis(2-hydroxethyl)-N-cyclohexylamine.

2. A modified insulating oil as claimed in claim 1, wherein the content of N,N-bis(2-hydroxyethyl)-N-cyclohexylamine is at least 0.5 mg/l.

3. An insulating oil as claimed in claim 1, wherein an increase in the tan δ of said insulating oil is suppressed.

4. An electrical apparatus filled with a modified insulating oil comprising;

a vessel;

an insulating oil containing N,N-bis(2-hydroxyethyl)-N-cyclohexylamine, said oil being filled in said vessel; and a copper component immersed in said insulating oil.

5. An electrical apparatus as claimed in claim 4, wherein the content of N,N-bis(2-hydroxyethyl)-N-cyclohexylamine is at least 0.5 mg/l.

6. An electrical apparatus as claimed in claim 4, wherein said copper component is a copper wire.

7. An electrical apparatus as claimed in claim 4, wherein said copper component is a copper foil.

* * * * *